United States Patent [19]

Kamiyama

[11] 4,250,825

[45] Feb. 17, 1981

[54] UNDER THREAD DETECTION FOR SEWING MACHINES WITH AXIALLY SPRING BIASED ROTATABLE MEMBER

[75] Inventor: Toshibumi Kamiyama, Kadoma, Japan

[73] Assignee: Matsushita Electric Industrial Co., Ltd., Osaka, Japan

[21] Appl. No.: 16,494

[22] Filed: Mar. 1, 1979

[30] Foreign Application Priority Data

| | | | |
|---|---|---|---|
| Mar. 2, 1978 | [JP] | Japan | 53/24281 |
| Jul. 21, 1978 | [JP] | Japan | 53/100930[U] |
| Nov. 20, 1978 | [JP] | Japan | 53/160469[U] |

[51] Int. Cl.[3] ..... D05B 59/00

[52] U.S. Cl. ..... 112/278

[58] Field of Search ..... 112/273, 278; 139/273 A; 242/37 R

[56] References Cited

U.S. PATENT DOCUMENTS

| | | | |
|---|---|---|---|
| 2,420,275 | 5/1947 | Winberg | 112/278 |
| 3,601,073 | 8/1971 | Simpson | 112/273 X |
| 3,845,320 | 10/1974 | Winberg | 139/273 A X |
| 3,991,692 | 11/1976 | Papajewski et al. | 112/278 |

*Primary Examiner*—Peter P. Nerbun

*Attorney, Agent, or Firm*—Lowe, King, Price & Becker

[57] ABSTRACT

A sewing machine having a rotary hook shaft, a bobbin case with a hollow cylindrical shaft journalled through the rotary hook shaft, and a bobbin rotatably mounted on the shaft of the bobbin case. An axially spring-biased cylindrical member is provided for unitary rotation with the bobbin and axially movable between a first position in which it is held against the lateral edges of the thread layers when the latter is present through the length of the cylinder of the bobbin and a second position in which the thread layers have reduced to a predetermined radial extent. A detector is provided to sense the axial movement of the spring-biased cylinder member from the first to second positions.

16 Claims, 11 Drawing Figures

UNDER THREAD DETECTION FOR SEWING MACHINES WITH AXIALLY SPRING BIASED ROTATABLE MEMBER

BACKGROUND OF THE INVENTION

1. Field of the Invention

The present invention relates to a sewing machine which gives a warning signal when the amount of under thread has reduced to a predetermined value.

2. Description of the Prior Art

In the usual sewing operation, upper or needle thread is supplied from a relatively large bobbin, while the under thread is supplied from a relatively small bobbin located beneath the sewing plate. Therefore, the operator has to frequently check the under thread bobbin to see if the amount of remaining thread is sufficient to complete a stitch without interruption.

Japanese Pat. No. 72-17586 discloses a device for detecting when the amount of remaining under thread reaches a predetermined value to give a warning signal. This device comprises a rotary hook having an opening therein and a bobbin case having an identical opening. When the openings of the rotary hook and the bobbin case are aligned to each other on a particular phase during rotary motions, a spring-loaded probe is automatically inserted into the aligned openings to make contact with the circumference of the under thread wound on the bobbin cylinder. When the amount of the under thread has reduced to a predetermined value the probe triggers a warning circuit to alert the operator. This probe is mounted on a pivot which rotates in synchronism with the rotary motion of the rotary hook so as to give a rocking movement to the probe. Since the probe is brought into contact with the under thread in the radial direction, this tends to give a considerable amount of impact to the under thread tension, so that the latter is drawn up with an increased tension when the probe is in contact therewith, which tends to give unsatisfactory results.

SUMMARY OF THE INVENTION

The present invention contemplates the use of an axially spring-biased cylindrical member which is rotatably mounted for unitary rotation with the bobbin and axially movable between first and second positions. When the bobbin shaft is fully wound through its axial length by the under thread, the spring-biased cylindrical member is held in the first position against the edge of the thread layers. When the amount of the under thread has reduced to a predetermined value, the cylindrical member is moved to the second position by the action of the spring. This axial displacement of the cylindrical member is detected to trigger a warning signal.

Preferably, the cylindrical portion of the bobbin is formed with a larger and a smaller diameter portion and the axially biased rotary cylindrical probe member is received in the larger diameter portion for unitary rotation therewith. In response to the consumption of the under thread on the larger diameter portion of the bobbin cylinder, the cylindrical member is caused to move from the first to second positions. The operator is thus allowed to continue sewing operation with the remaining under thread which is wound on the smaller diameter portion of the bobbin cylinder. A second cylindrical probe member is axially movably mounted on the bobbin case shaft and urged toward the first cylindrical probe member for unitary axial movement therewith, and provided with a projecting probe which extends through an opening provided in the bobbin case and projects from its forward end surface when the first cylindrical member is in the first position. The warning signal is derived from a proximity detector when the block member is axially displaced to a retracted position in response to the axial movement of the first cylindrical member. This proximity detector is mounted on a pivoted arm which is normally in a retracted position to clear off the area adjacent to the rotary hook to facilitate mounting of the bobbin case into the rotary hook shaft and moved to an operative position in which the detector is located in proximity to the sensing block member.

An object of the present invention is therefore to provide a sewing machine which gives a warning signal for the under thread without interfering with the normal sewing operation.

Another object of the invention is to provide an under thread detector which is simple in structure and easy to be mounted on the sewing machine.

A further object of the invention is to provide an under thread detector which is easily adapted to the existing sewing machine.

BRIEF DESCRIPTION OF THE DRAWINGS

The invention will be further described by way of example with reference to the accompanying drawings, in which.

DETAILED DESCRIPTION

Figure 3:
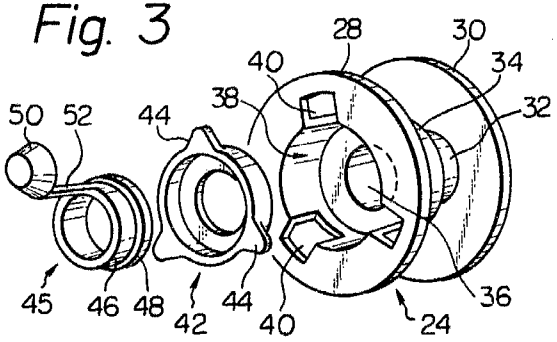
FIG. 3 is an exploded perspective view of the embodiment of FIG. 2 with the bobbin case being omitted.
Figure 1:
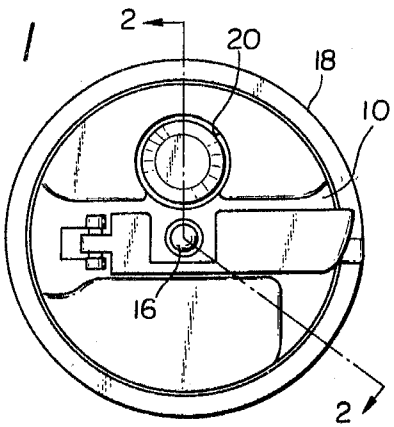
FIG. 1 is a front view of the bobbin case embodying the present invention shown mounted within a rotary hook.
Figure 2:
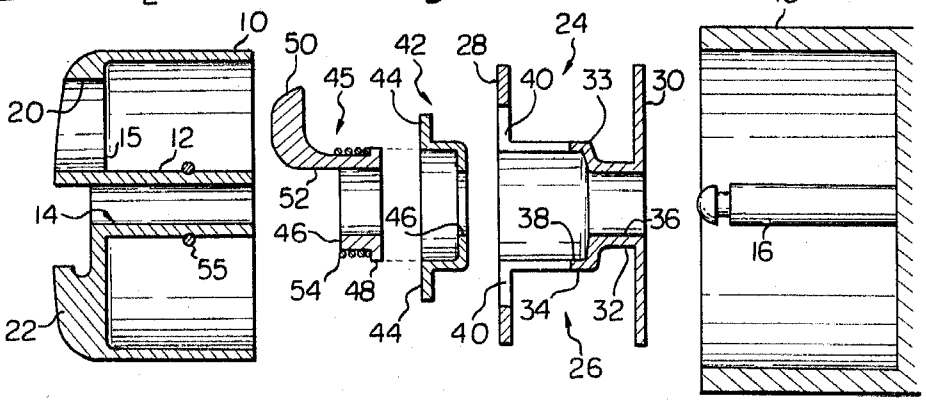
FIG. 2 is a cross-sectional view taken along the lines 2—2 of FIG. 1.

Referring now to FIGS. 1 to 3, an embodiment of the present invention is illustrated as comprising a bobbin case 10 having a cylinder 12 with an axially extending throughbore 14 therein through which the shaft 16 of the rotary hook 18 is journalled as in the conventional manner. The bobbin case 10 is formed with an opening 20 on its front wall 22. The bobbin 24 comprises a cylinder 26 and flanges 28 and 30 at opposite ends of the cylinder 26. The cylinder 26 is formed with a smaller diameter section 32 adjacent to the flange 30 and a larger diameter section 34 adjacent to the flange 28. Between the larger and smaller diameter sections is formed a varying diameter section 33, with the diameter increasing from the smaller to the larger diameter sections. The smaller diameter section 32 has an axially extending bore 36 which is journalled through the cylinder 12 when the bobbin is rotatably mounted therein. The larger diameter section 34 has a bore 38 coaxial with the bore 32 and is formed with a set of three axially extending cutouts or guide slots 40. A cup-shaped cylindrical probe member 42 is provided which is formed with a set of three radially extending projections or guide flanges 44 and a bore 46 having the same diameter as the diameter of the bore 36. When the bobbin 24 is received in the bobbin case 10 the probe member 42 is received in the larger diameter section 34 with the flanges 44 being received respectively in the corresponding guide slots 40 of the larger diameter section 34.

Figure 4:
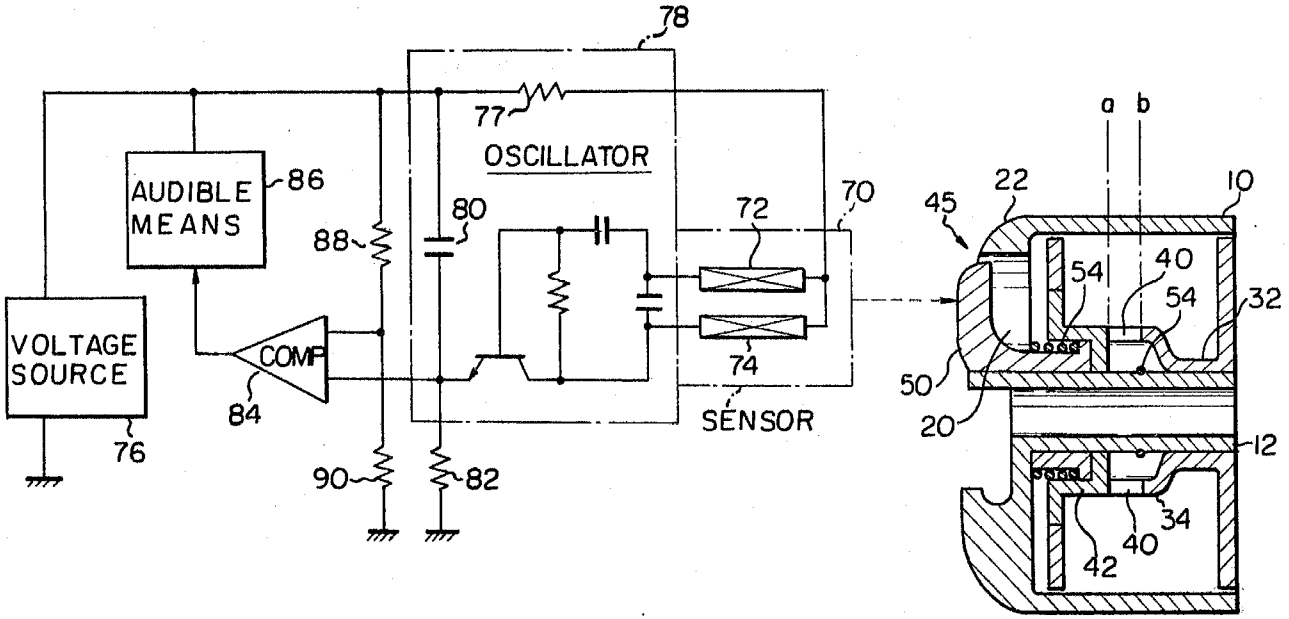
FIG. 4 is a cross-sectional view of the embodiment of FIG. 1 with all the components being nestled together within the bobbin case and a schematic circuit diagram of a proximity detector shown located in proximity to the front surface of the bobbin case.

An axially movable cylindrical probe member 45 is provided which comprises a cylinder 46 with a flange 48 and a round-surfaced block or projecting probe 50 mounted forward of the cylinder 46 by an extension arm 52. Around the cylinder 46 is provided a coiled spring 54 which axially extends between the inner wall 15 of the bobbin case 10 and the flange 48. The probe member 45 is journalled through the shaft 12 of the bobbin case 10 and axially movable between a forward position in which the projecting probe 50 projects from the front wall 22 of the bobbin case as illustrated in FIG. 4 and a rearward position in which the probe 50 is retracted from the front end wall 22. The spring 54 urges the axially moving probe 45 to the right as well as the rotary probe member 42 toward the smaller diameter section 32 of the bobbin 24. The axial probe 45 and rotary probe 42 are nestled together within the bobbin case 10 as illustrated in FIG. 4 and prevented from being dislocated therefrom by means of a ring 55.

As in the conventional manner, the bobbin 24 is detachably and rotatably mounted on the shaft 12 of the bobbin case 10 with under thread being coiled around through the axial length of the larger and smaller diameter sections of its cylinder 26. The under thread is so wound that its beginning end starts on the smaller diameter section 32 and when the amount of that thread measured in the radial direction reaches the circumference of the larger diameter section 34 the thread is shifted to the larger diameter section 34 and levels off through the axial length of the cylinder 26 until it is wound to the outer edge of the flanges 28, 30.

With the under thread being wound on the bobbin 24, the latter is rotatably mounted when in operation on the shaft 12 of the bobbin case 10, so that the rotary probe member 42 is received in the larger diameter section 34 with its flanges 44 being fitted respectively into the guide slots 40, as illustrated in FIG. 4. The bobbin case 10, with all the elements being accommodated therein, is mounted on the shaft 16 as in the conventional manner. When the bobbin 24 is fully loaded with the thread, the flanges 44 of the probe 42 are held by the spring 54 against the overlying turns of the thread wound on the larger diameter section 34, whereby the rotary probe 42 is held in a position a as indicated in FIG. 4. When the under thread has been consumed so that the larger diameter section 34 has no layers of thread on it, the rotary probe 42 is allowed to move axially to a position b by the action of the spring 54 through the guide slots 40. This causes the axially movable probe 45 and hence its projecting probe 50 to retract from the forward to rearward positions.

The axial displacement of the probe 50 is detected by means of a proximity sensor which will be described later in detail. Since the axial displacement is detected when the thread has been consumed to leave no thread on the larger diameter section 34, the sewing operation is still allowed to continue with the thread remaining on the smaller diameter section 32.

The under thread is conventionally drawn up through a hole provided in the bobbin case at a position near its front end, so that if sewing operation continues after consumption of the thread on the larger diameter section, the remaining thread on the smaller diameter section will be drawn up at an angle inclined toward the larger diameter section. The gradually varying diameter section 33 provides a smooth surface for the drawn up thread, thus avoiding a damage on the under thread. The rounded surface of the projecting probe 50 has the effect of allowing the upper or needle thread to pass smoothly around the front surface of the bobbin case when both upper and under threads are drawn up by the action of the thread take-up lever (not shown).

Figure 5C:
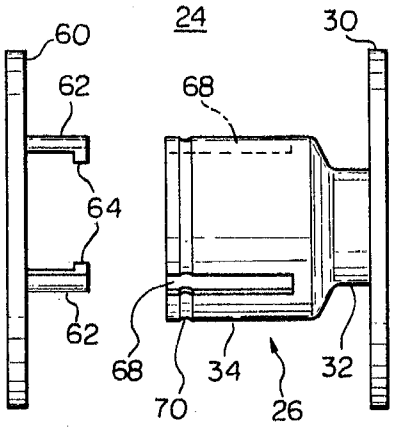
FIG. 5C is a side view of the modified bobbin.
Figure 5A:
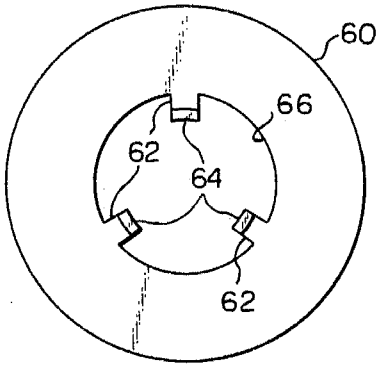
FIG. 5A is an end view illustrating a flange of the bobbin according to a modified embodiment of the invention.
Figure 5B:
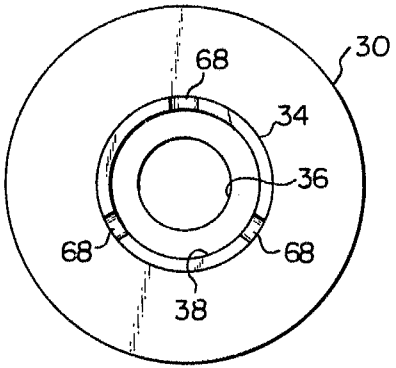
FIG. 5B is an end view illustrating another flange of the bobbin of the modified embodiment.

FIGS. 5A to 5C illustrate a modification of the previous embodiment. In this modified embodiment, the rotary probe 42 and the bobbin 24 are combined to provide dual functions. As illustrated, the bobbin 24 comprises a flange 60 having a set of three axially extending parallel prongs 60 each being formed with a radially inwardly bent portion 64. The prongs 60 are disposed inward of the bore 66 through which the larger diameter section 34 extends. The larger diameter section 34 is formed with a set of three axially parallel guide slots 68 in which the prongs or guide followers 62 are respectively accommodated, and a groove 70 in which a ring (not shown) is inserted when the flange 60 engages the larger diameter section 34 of the cylinder 26 to prevent them from being decoupled from each other. When the under thread is wound on the bobbin cylinder 26, the movable flange 60 is held against the ring on the groove 70. As the bobbin 24 is mounted in the bobbin case 10, the axially movable member 45 is snugly fit into the bore 38 of the larger diameter section 34 for engagement with the projections 64, so that the axially movable flange 60 is urged by the spring 54 against the lateral edges of thread layers on the larger diameter section 34. When the thread on the larger diameter section 34 has been consumed, the flange 60 is caused to move to the right by the action of the spring 54, whereby the axially movable member 45 is moved to the retracted position.

The detection of axial displacement of the projecting probe 50 is achieved in a number of ways. Referring back again to FIG. 4, one way of displacement detection is illustrated in which a pair of sensor coils 72 and 74 is housed in a probe 70 adjacent to the projection 50 and forms part of an oscillator 78. In this embodiment, the projection 50 is formed of a material having a high iron loss, so that the oscillator 78 is prevented under the influence of the high loss from generating oscillation when the projection 50 is located in the normal position. When the projection 50 is moved to the right in response to the consumption of the under thread on the larger diameter section, the oscillator 78 is allowed to initiate oscillation which is rectified by a capacitor 80 and a resistor 82 to generate a DC voltage which is sensed by a comparator 84 to operate an audible means 86 when the DC voltage is higher than a reference voltage set by a voltage divider formed by resistors 88 and 90. A warning signal is thus given, indicating that the amount of under thread has been consumed to a predetermined amount.

Figure 6:
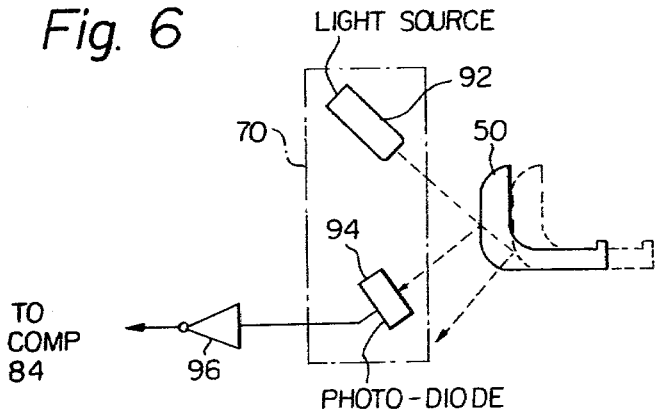
FIGS. 6 to 8 are various modifications of the proximity detector.

In FIG. 6, the probe 70 comprises a light source, preferably a light-emitting diode 92 and a photosensitive element such as a photo-transistor 94 which are at an angle to the center line of the projection 50. The light beam emitted from the light-emitting diode 92 is reflected on the surface of the projection 50 when the latter is in the normal position and sensed by the photo-transistor 94. When projection 50 is in the retracted position the path of the reflected beam is diverted out of the light receiving area of the photo-transistor 94 so that the output of the photo-transistor goes low. The low level signal is inverted by an inverter 96 and applied to the comparator 84 to generate a warning signal.

Figure 7:
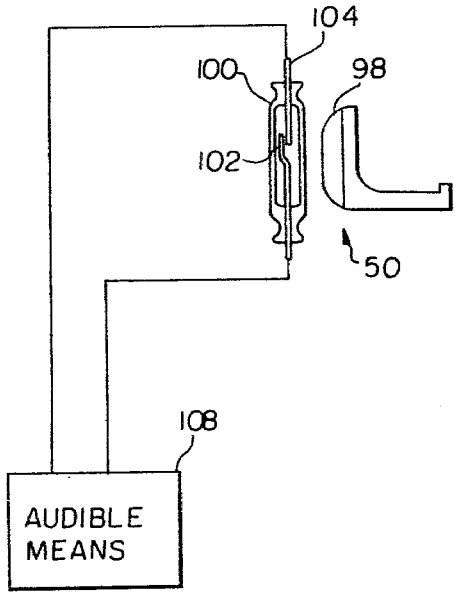

In FIG. 7, the projection 50 is provided with a permanent magnet 98 and the sensing probe comprises a reed switch 100 having a magnetized moving contact arm 102 and a stationary contact arm 104 which are connected to an audible means 108. By the repelling action of the magnet 98, the magnetized contact arm 102 is normally held away from contact with the arm 104. These contact arms are brought into electrical contact when projection 50 is moved to the retracted position to activate the audible means 108.

Figure 8:
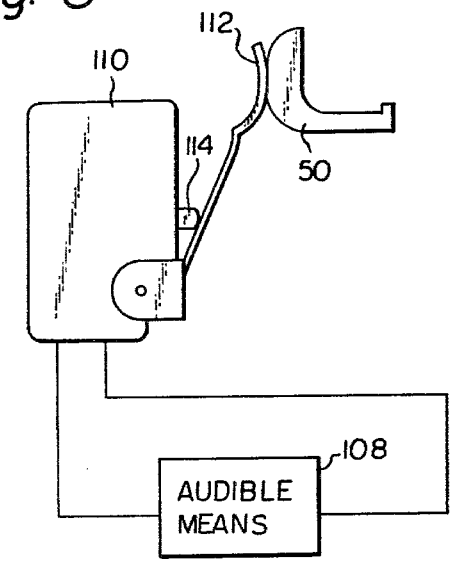

Alternatively, a microswitch 110 can also be employed as illustrated in FIG. 8. This microswitch includes a spring-loaded sensing arm 112 having a curved end portion in contact with the surface of projection 50, so that the arm 112 is moved to the right in response to the axial movement of projection 50. The sensing contact 114 is normally in a retracted position when the sensing arm 112 is in the normal leftward position and is moved to an extended position when the arm 112 moved to the right, completely a circuit for the audible means 108.

Figure 9:
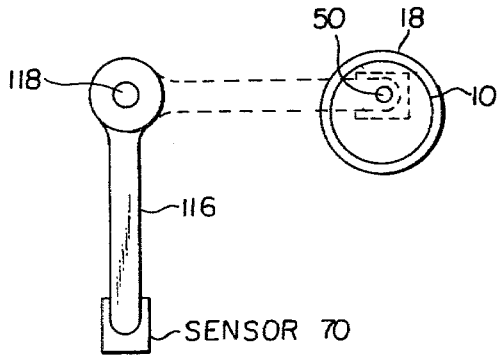
FIG. 9 is a front view of the proximity detector shown mounted on a pivoted arm.

As shown in FIG. 9, the sensor 70 is mounted on a free end of an arm 116 which is pivoted at 118 and normally held in a vertical position to permit the insertion of the bobbin case 10 into the rotary hook 18 and moved to a horizontal position during operation in which the sensor 70 is brought into proximity to projection 50.

What is claimed is:

1. A sewing machine comprising a rotary hook having a shaft, a bobbin having a cylinder on which under thread of the machine is wound, a bobbin case having a cylinder detachably mounted on said rotary hook shaft, the cylinder of said bobbin being rotatably and detachably mounted on the cylinder of said bobbin case, said cylinder of said bobbin comprising a larger diameter section having a plurality of axially extending parallel guide slots and a smaller diameter section, a movable member mounted on said bobbin case shaft and slidably received in said guide slots for rotation with said bobbin, said movable member being normally located at one end of said larger diameter section remote from said smaller diameter section when said under thread is present on said larger diameter section, means for urging said movable member toward said smaller diameter section so that the absence of said under thread on said larger diameter section will cause said movable member to axially move toward said smaller diameter section, and means for detecting the axial movement of said movable member to give a warning indication.

2. A sewing machine as claimed in claim 1, wherein said bobbin comprises a pair of flanges between the opposite ends of the bobbin cylinder, one of said flanges constituting said movable member and having a bore for axially slidably receiving said larger diameter section of said bobbin cylinder.

3. A sewing machine as claimed in claim 1, further comprising a second movable member axially slidably mounted on the cylinder of said bobbin case and axially slidably received in the first-mentioned movable member and having a flange at one end thereof and an axially extending projection at the opposite end thereof, said bobbin case having an opening therein to permit said projection to axially move therethrough, said urging means being disposed between a front wall of said bobbin case and said flange of said second movable member to urge the same toward said first movable member.

4. A sewing machine as claimed in claim 3, wherein said projection has a round surface portion.

5. A sewing machine as claimed in claim 3, wherein said detecting means comprises means for electromagnetically detecting the axial displacement of said projection.

6. A sewing machine as claimed in claim 5, wherein said projection is formed of a material having a relative high iron loss, and wherein said electromagnetically detecting means comprises an oscillator having a sensing coil sensitive to the high iron loss of said projection to suspend oscillation when said projection is in proximity to said sensing coil.

7. A sewing machine as claimed in claim 5, wherein said electromagnetic detecting means comprises a reed switch having a magnetized moving contact arm and a stationary contact arm, and wherein said projection includes a permanent magnet for keeping said magnetized moving contact arm away from said stationary contact arm when said projection is in proximity to said reed switch.

8. A sewing machine as claimed in claim 3, wherein said detecting means comprises means for photoelectrically detecting the axial displacement of said projection.

9. A sewing machine as claimed in claim 8, wherein said photoelectrically detecting means comprises a light source for providing a beam of light toward said projection to reflect the light therefrom and a light sensitive element for generating an electrical signal in response to receipt of the reflected light beam.

10. A sewing machine as claimed in claim 3, wherein said detecting means comprises means for electromechanically detecting the axial displacement of said projection.

11. A sewing machine as claimed in claim 1, wherein said cylinder of said bobbin includes a gradually varying diameter section between said larger and smaller diameter sections, the diameter of said gradually varying diameter section increasing from said smaller to larger diameter sections.

12. A sewing machine as claimed in claim 3, further comprising a pivoted arm rotatable between a first portion remote from said rotary hook and a second position adjacent to said rotary hook, and wherein said detecting means is mounted on a free end of said pivoted arm so that when said arm is in said second position said detecting means is in proximity to said projection.

13. A device for use in a sewing machine having a rotary hook with a shaft therein, comprising a bobbin having a cylinder on which the under thread of the machine is wound, a bobbin case having a cylinder detachably mounted on said rotary hook shaft, the cylinder of said bobbin being rotatably and detachably mounted on the cylinder of said bobbin case, said cylinder of said bobbin comprising a large diameter section having a plurality of axially extending parallel guide slots and a smaller diameter section, a movable member mounted on said bobbin case shaft and axially slidably received in said guide slots for rotation with said bobbin, said movable member being normally located at one end of said large diameter section remote from said smaller diameter section when said under thread is present on said large diameter section, means for urging said movable member towards said smaller diameter section so that the absence of said under thread on said large diameter section will cause said movable member to axially move toward said smaller diameter section.

14. A device as claimed in claim 13, wherein said cylinder of said bobbin is formed with a varying diameter section between said smaller and larger diameter sections, said varying diameter increasing from said smaller to larger diameter sections.

15. A device as claimed in claim 13, wherein said bobbin comprises a pair of flanges between the opposite ends of the bobbin cylinder, one of said flanges constituting said movable member and having a bore for axially slidably receiving said larger diameter section of said bobbin cylinder.

16. A device as claimed in claim 13, further comprising a second movable member axially slidably mounted on the cylinder of said bobbin case and axially slidably received in the first-mentioned movable member and having a flange at one end thereof and an axially extending projection at the opposite end thereof, said bobbin case having an opening therein to permit said projection to axially move therethrough, said urging means being disposed between a front wall of said bobbin case and said flange of said second movable member to urge the same toward said first movable member.

* * * * *